US009789680B2

(12) United States Patent
Frankenberg et al.

(10) Patent No.: US 9,789,680 B2
(45) Date of Patent: Oct. 17, 2017

(54) METHOD FOR ADJUSTING THE PRINT REPEAT LENGTH OF A PRINT IMAGE IN A MULTICOLOR ROTARY PRINTING MACHINE

(71) Applicant: Windmoeller & Hoelscher KG, Lengerich (DE)

(72) Inventors: Mario Frankenberg, Osnabrueck (DE); Rainer Ehrenberg, Hasbergen (DE); Frank Westhof, Recke (DE); Uwe Hoewelmeyer, Ibbenbueren (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 0 days.

(21) Appl. No.: 14/415,000

(22) PCT Filed: Jul. 31, 2013

(86) PCT No.: PCT/EP2013/066127
§ 371 (c)(1),
(2) Date: Jan. 15, 2015

(87) PCT Pub. No.: WO2014/020083
PCT Pub. Date: Feb. 6, 2014

(65) Prior Publication Data

US 2015/0183206 A1 Jul. 2, 2015

Related U.S. Application Data

(60) Provisional application No. 61/677,608, filed on Jul. 31, 2012.

(51) Int. Cl.

| | |
|---|---|
| ***B41F 5/24*** | (2006.01) |
| ***B41F 33/00*** | (2006.01) |
| ***B41F 13/14*** | (2006.01) |

(52) U.S. Cl.
CPC ..... *B41F 5/24* (2013.01); *B41F 13/14* (2013.01); *B41F 33/0081* (2013.01);
(Continued)

(58) Field of Classification Search
CPC ..... B41F 13/24; B41F 5/24; B41F 33/0081; B41F 13/14; B41P 2200/12; B41P 2213/73; B41P 2233/52
See application file for complete search history.

(56) References Cited

U.S. PATENT DOCUMENTS

| | | | |
|---|---|---|---|
| 5,787,811 | A | 8/1998 | Achelpohl et al. |
| 7,584,699 | B2 | 9/2009 | Ford |

(Continued)

FOREIGN PATENT DOCUMENTS

| | | |
|---|---|---|
| DE | 19527199 | 1/1997 |
| EP | 0796733 | 9/1997 |

(Continued)

*Primary Examiner* — David Banh
(74) *Attorney, Agent, or Firm* — Jacobson Holman, PLLC.

(57) ABSTRACT

A method of adjusting the print repeat length of a print image in a multicolor rotary printing machine, particularly a flexographic printing press, having a central impression cylinder, a first plate cylinder, and a second plate cylinder, including modifying the peripheral velocity of the first plate cylinder and the peripheral velocity of the second plate cylinder during printing operation, relative to the peripheral velocity of the central impression cylinder, and adjusting the longitudinal register of the first plate cylinder having the modified peripheral velocity and the longitudinal register of the second plate cylinder having the modified peripheral velocity.

10 Claims, 2 Drawing Sheets

(52) U.S. Cl.
CPC ..... *B41P 2200/12* (2013.01); *B41P 2213/73* (2013.01); *B41P 2233/52* (2013.01)

(56) References Cited

U.S. PATENT DOCUMENTS

| | | | | |
|---|---|---|---|---|
| 2005/0153100 | A1* | 7/2005 | Zoller | B31F 1/07 428/131 |
| 2008/0264280 | A1* | 10/2008 | Baggot | B41F 13/12 101/248 |
| 2009/0078134 | A1* | 3/2009 | Rothlein | B41F 5/24 101/141 |
| 2010/0018419 | A1* | 1/2010 | Whitelaw | B41F 5/18 101/248 |
| 2011/0046591 | A1* | 2/2011 | Warner | A61F 13/15772 604/367 |
| 2011/0297026 | A1 | 12/2011 | Zeinhofer | |
| 2015/0096452 | A1* | 4/2015 | Puig Vil | B41F 9/003 101/152 |

FOREIGN PATENT DOCUMENTS

| | | |
|---|---|---|
| EP | 2346688 | 7/2011 |
| EP | 2392459 | 12/2011 |
| WO | WO 2006/010116 | 1/2006 |
| WO | WO 2006/134070 | 12/2006 |
| WO | WO 2010/079346 | 7/2010 |

* cited by examiner

METHOD FOR ADJUSTING THE PRINT REPEAT LENGTH OF A PRINT IMAGE IN A MULTICOLOR ROTARY PRINTING MACHINE

CROSS-REFERENCE TO RELATED APPLICATIONS

This is a national stage of PCT/EP2013/066127 filed Jul. 31, 2013, and published in German and claims benefit of U.S. Provisional Application No. 61/677,608, filed Jul. 31, 2012.

BACKGROUND OF THE INVENTION

1. Field of Invention

The invention relates to a method for adjusting the print repeat length of a print image in a multicolor rotary printing machine.

2. Description of the Prior Art

In a multicolor rotary printing machine, the multicolor print image is transmitted to the print substrate by multiple printing cylinders—the so-called plate cylinders—each transferring a color to the print substrate one after the other, wherein the regions of the plate cylinder which carry the color ink entirely or partially transfer this color ink to the print substrate. Multiple colors which overlap then form the print image.

The print substrate in this case is guided via one or multiple central impression cylinders. If there is only one central impression cylinder, the plate cylinder is positioned against this central impression cylinder, such that the color inks are transferred as completely as possible.

If there are multiple central impression cylinders, a single plate cylinder is frequently functionally assigned to each central impression cylinder such that the peripheral velocity can be adjusted very precisely. However, two or even more plate cylinders can also be functionally assigned to each central impression cylinder.

In general, the peripheral velocities of all plate cylinders should be identical, and also match the peripheral velocity or velocities of the central impression cylinder or central impression cylinders. In the printing machines used today, each individual cylinder is equipped with its own, position-controlled drive such that the peripheral velocity can be very precisely adjusted. High print quality is achieved when all rolls participating in the printing process have the same peripheral velocities.

For a given circumference of the plate cylinders, which can also be identical for each of the same, the so-called print repeat length is defined by one rolling of the plate cylinder on the print substrate. If the print repeat length is changed, the plate cylinder or parts thereof—particularly the so-called print sleeve—must normally be exchanged for a larger or smaller circumference.

However, U.S. Pat. No. 7,584,699 B2 suggests modifying the peripheral velocity of the plate cylinder relative to the peripheral velocity of the central impression cylinder or the central impression cylinders, in order to thereby make it possible to vary the print repeat length. The assumption is made that a modification of less than 1% of the original print repeat length has no effect, or at least no noticeable effect, on the print quality. The background to this suggestion is that the printed and re-rolled print substrate, consisting of plastic, changes its length over time. As such, relaxation effects can arise which shrink the film or stretch the same. In order to then make it possible to observe a print image of the desired length, the shrinkage or elongation is anticipated, and an accordingly elongated or shortened print image is produced during the print process, and the plate cylinder is not exchanged for another.

Even though modern printing machines have a position-controlled drive for each cylinder, it is only possible to carry out such a modified adjustment of the peripheral velocity when the printing machine is halted. This consumes a great deal of time, and is therefore costly.

SUMMARY OF THE INVENTION

This problem is addressed by the features of the invention described herein.

This problem is addressed by the features of claim 1.

According to the invention the peripheral velocity of the first plate cylinder is modified during the ongoing printing operation, relative to the peripheral velocity of the central impression cylinder. For this purpose, the control and/or regulation device, which advantageously runs as a program on a control and/or regulation computer, can be informed of the value of the desired peripheral velocity of the plate cylinder or the desired deviation from the peripheral velocity of the central impression cylinder. This can be performed manually or according to a table which contains such values in dependence on the time and/or the length of the material web which has already been printed. However, it can also be contemplated that a mathematical function or an empirically determined dependency is used—as is suggested in U.S. Pat. No. 7,584,699 B2 named above. If the peripheral velocity of the plate cylinder is reduced relative to the peripheral velocity of the central impression cylinder, an elongated print image results. However, if the peripheral velocity of the plate cylinder is increased relative to the peripheral velocity of the central impression cylinder, a shortened print image is observed.

This method is particularly advantageous for use in a flexographic printing machine. Flexography is a letterpress process—meaning that the raised regions of the plate cylinder or printing plate are the regions which effect the printing. The printing plates in this case consist of flexible materials such as polymers, such that the printing plates can properly cope with the bending forces produced by the slightly different peripheral velocities of the plate cylinder and central impression cylinder.

A difficulty arises at this point if multiple, single-color partial images are supposed to be printed to make a multi-color print, matching the impression made by the first plate cylinder with its modified velocity. In a further embodiment, therefore, the peripheral velocity of at least one further plate cylinder is also modified at the same time as the modification of the peripheral velocity of the first plate cylinder. The peripheral velocities of these plate cylinders in this case should be identical, at least following several rotations.

In a further embodiment of the invention, the peripheral velocity of not only one additional plate cylinder, but rather of all further plate cylinders is modified at the same time as the first plate cylinder.

In the methods according to the invention described above, the term 'peripheral velocities' means the target peripheral velocities. The target peripheral velocities in this case depend on the peripheral velocity of the central impression cylinder or central impression cylinders, and are only slightly modified relative to the peripheral velocities thereof. The actual peripheral velocities of the plate cylinders in this case can, however, deviate from the target plate cylinder, as described below, because additional adjustment parameters influence the actual peripheral velocity.

When the target peripheral velocities of different plate cylinders are modified at the same time, the problem arises that the longitudinal register is then generally no longer adjusted to match. A well-adjusted longitudinal register ensures that the individual colors of a print image are printed on top of each other, and together accordingly form the desired print image.

When the target peripheral velocities of at least two of the plate cylinders are modified at the same time, at least a part of the print image printed by the first plate cylinder has at [sic] the original peripheral velocity—that is, at the original print repeat length. At this point, if a further plate cylinder which is already operated at the modified speed prints over this print image, an error in the longitudinal register necessarily results. This produces paper waste, which should be prevented.

One suitable measure for preventing the creation of waste paper is that of controlling the additional plate cylinders as follows: the longitudinal register is controlled at the same time as the new target peripheral velocity is specified, in such a manner that the longitudinal register is preserved, or at least only briefly disturbed, despite the modified peripheral velocity.

It is possible to completely avoid paper waste if the longitudinal register is controlled in such a manner that it likewise performs a modification of the target peripheral velocity, wherein the target peripheral velocity specified by the longitudinal register has precisely the same magnitude as the modification of the target peripheral velocity used to generate a different print repeat length, but works against this modification. In sum, a peripheral velocity which corresponds to the original peripheral velocity is preserved. The control procedure for the longitudinal register is maintained up to the point on the print substrate at which the print image with the modified print repeat length starts and reaches the roll gap between the additional plate cylinder and the central impression cylinder. This point in time is simple to calculate, and only depends on the velocity of the central impression cylinder ($v_{impression\ cylinder}$)—via $\Delta t = \Delta L / v_{impression\ cylinder}$—wherein $\Delta L$ is the roll gap of the two plate cylinders with the central impression cylinder, measured along the surface of the central impression cylinder.

In one preferred embodiment of the invention, a control and/or regulating program is used which comprises multiple procedures. In the scope of this application, 'procedures' indicates individual program components which fulfil a certain function. However, such procedures can also be termed 'functions'. Also, other terms may also be used in the field of IT.

Such a procedure can serve the purpose of controlling the target peripheral velocities, by way of example, and can contain the target print repeat length as an input parameter, by way of example. In this case, a result would be a value for the target peripheral velocity which is then relayed to the program component which is responsible for the position regulation of a printing roll.

A further procedure which can be contemplated for the adjusting of the longitudinal register of plate cylinders can likewise calculate the value of the target peripheral velocity, and provision this value with the opposite sign, and also calculate the duration of the length of the longitudinal register adjustment according to the position of the plate cylinder being controlled. These two values as well are transferred to the program component which is responsible for the position regulation.

At this point, the two values for the differences of the target peripheral velocity and the current peripheral velocity of the central impression cylinder are added to the current velocity, according to the amount of time t which has passed, in the program component for the position regulation of a certain plate cylinder. If the time $\Delta t$ has run out, the difference between the original peripheral velocity and the target velocity used to modify the longitudinal register equals zero, such that the affected plate cylinder at this point is running in proper register with the new target peripheral velocity which is necessary for modifying the print repeat length without the print image ever running out of the register.

The invention also includes a control and/or regulating device in which the plate cylinders described above are implemented, as well as a printing machine which includes a control and/or regulating device as named. This printing machine is also equipped with one or multiple central impression cylinders which transport a print substrate web, wherein one or multiple plate cylinders can be brought into contact with each of the same. In a particularly advantageous embodiment, the printing machine is a central impression cylinder flexographic printing press.

BRIEF DESCRIPTION OF THE DRAWINGS

Further embodiments are found in the additional claims and the drawings, wherein:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
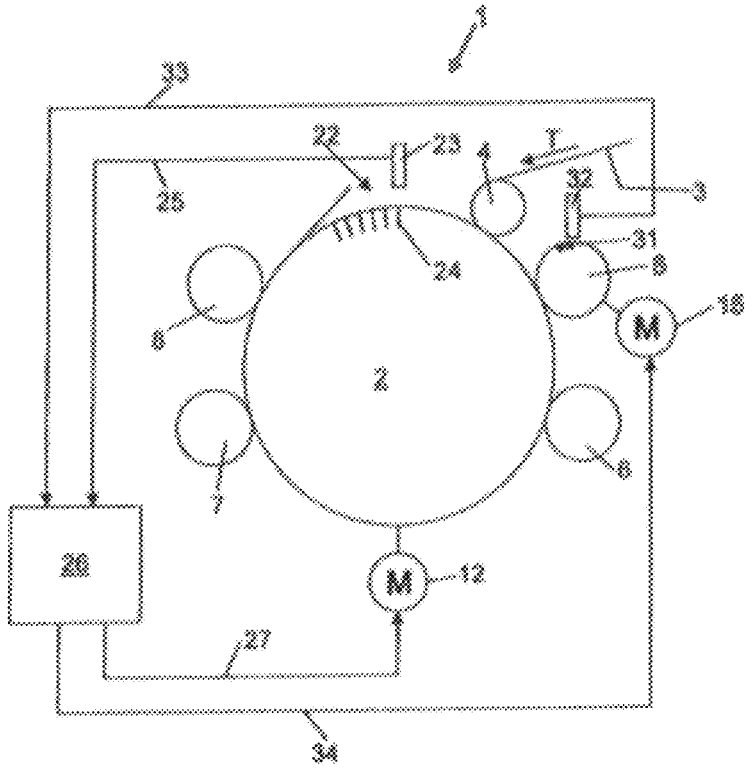
FIG. 1 shows a schematic view of a flexographic printing press with a control device.

FIG. 1 shows a schematic illustration of a flexographic printing press 1, which has a central impression cylinder 2. A web of print substrate 3 is fed in the direction of the arrow T, and is laid onto the central impression cylinder 2 by means of a pressure roller 4. Multiple—and particularly 4 in the shown embodiment—plate cylinders 5, 6, 7, 8 are distributed about the periphery of the central impression cylinder 2, each printing one color. However, only the first has not been shown [sic], but devices for the purpose of conveying ink are part of each printing machine, wherein the letterpress printing regions of the plate cylinders are supplied with color ink via the same. In flexographic printing presses, such a device generally comprises an anilox roll for the purpose of inking the print regions, and a doctor blade which works together with the anilox roll.

In addition, FIG. 1 shows components of the flexographic printing press 1 which serve the purpose of driving cylinders. As such, the central impression cylinder 2 is driven by its own drive 12. The letter M in the illustration stands for 'motor'. Even if the motor is operated at a prespecified power, which should lead to a constant rotation speed, fluttering can occur. In order to make it possible to determine the actual rotation speed, a rotation speed detection device is included, indicated overall with the reference number 22. The rotation speed detection device has a sensor 23 by means of which it is possible to detect the markings 24 which are arranged on the central impression cylinder 2. The detected markings are relayed to the analysis and control device 26 via a data line 25, which analyzes the markings therefrom per unit of time, and from this determines the actual angular and peripheral velocity. If a deviation from the desired angular velocity is found, the motor can be accordingly controlled such that target and current velocities equalize. A control path is therefore available for this case. A control line leads from the analysis and control device 26 to the motor 12.

In flexographic printing presses in the prior art, the individual plate cylinders should have the same peripheral velocities at every point in time as the central impression cylinder 2. For this purpose, the same control path is used as for the central impression cylinder 2. Such a control path is only illustrated for the plate cylinder 5, but is likewise present for the other plate cylinders. It is initially important that the rotation of each plate cylinder is started by its own drive. The drive in the case of plate cylinder 5 has the reference number 15. The control device in this case also includes the markings 31, the sensor 32, and the control line 33, which relays the number of the markings measured by the sensor to the analysis and control device 26. The latter evaluates the measured value with respect to a unit of time, and in turn determines the current peripheral velocity of the plate cylinder 5. The current peripheral velocity is also compared to a target velocity, wherein in this case the target velocity is not a prespecified velocity, but rather the current velocity of the central impression cylinder. As a result of this approach, the method ensures that the peripheral velocities of the central impression cylinder and the plate cylinders are always the same.

At this point, if the peripheral velocities of the plate cylinders 5, 6, 7, 8 are intended to be modified relative to the central impression cylinder, the corresponding differences are added to the target velocities of the plate cylinders. These differences can result in a higher peripheral velocity, and result in a slightly shortened print repeat length. In contrast, a reduced peripheral velocity leads to an elongated print image.

Figure 2:
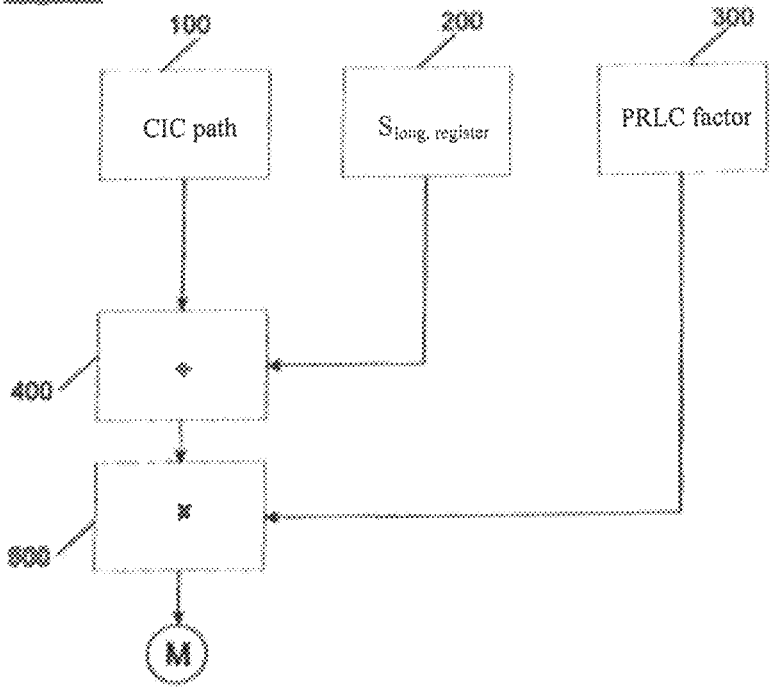
FIG. 2 shows the process of a method according to the invention for adjusting the print repeat length.

One embodiment of a circuit or a program procedure is shown in FIG. 2. The individual boxes in this figure are accordingly intended as circuit components or parts of a program—for example as procedures. The drive of a plate cylinder is controlled in this was. As described above, the basis for the control operation of the drive is the current peripheral velocity of the central impression cylinder. This is illustrated in box 100, wherein the path of the central impression cylinder (CIC path) traveled per unit of time is taken as the basis. For a printing wherein not all plate cylinders are yet in the register, the missing path difference is added in order to achieve a satisfactory register. The path difference in the register is generally detected by register sensors which scan the printing marks of the individual colors. The missing path difference continues to be added until the register matches ($S_{long,\ register}$). This is indicated by the reference number 200. The actual addition is performed in the component and/or procedure 400.

At this point, if a velocity difference between the central impression cylinder and the affected plate cylinder is added, the path sum is multiplied by a factor which is greater or smaller than 1. This occurs in the multiplier, which is shown as box 500. The result is a path specification which the periphery of the plate cylinder has traveled during one unit of time. The motor M is controlled according to this specification.

Figure 3:
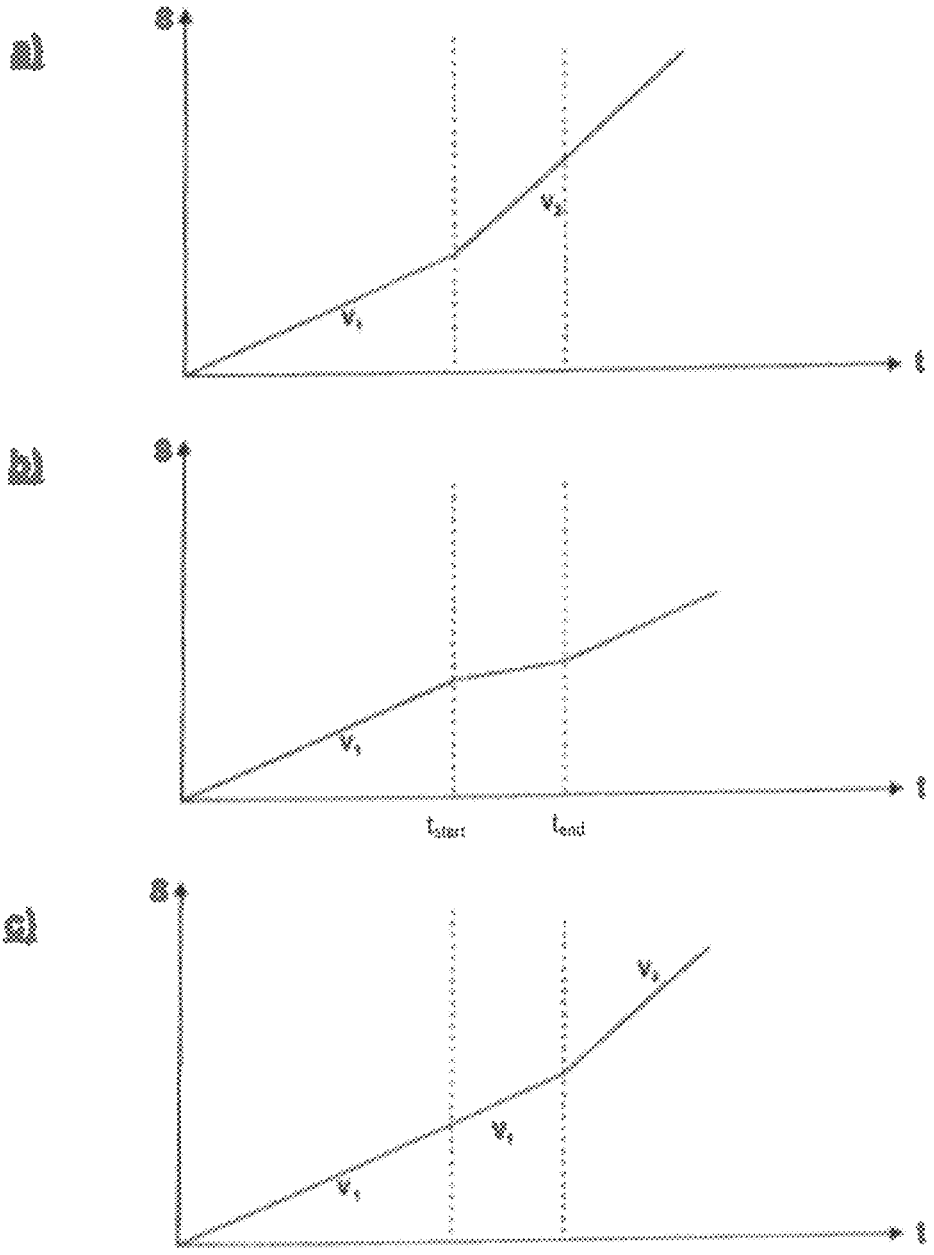
FIG. 3 shows various velocity curves of a plate cylinder when the velocity thereof is modified.

An approach is illustrated in FIG. 3, by means of which it is possible to add the velocity difference for all plate cylinders at the same time, and to prevent a longitudinal register deviation. For this purpose, the velocity difference $\Delta v$ from the new velocity $v_2$ is determined proceeding from the original peripheral velocity $v_1$. A resulting velocity curve is illustrated in FIG. 3 *a*), wherein the peripheral velocity of the affected plate cylinder was simply modified from $v_1$ to $v_2$ at a time point $t_{Start}$.

Along with the time point at which the new velocity v2 is added, this difference path is incorporated as a longitudinal register path to be corrected. This longitudinal register path continues to be incorporated from time point t1 until the difference path traveled per unit of time is determined from $\Delta v$. This difference path is taken into account as the longitudinal register path to be corrected, along with the time point of the adding of the new velocity. This longitudinal register path is incorporated at this point, starting at $v_1$, for the time in which the print substrate needs to travel at the given peripheral velocity from the first plate cylinder (see reference number 5 in FIG. 1) to the plate cylinder being adjusted. The duration needed for this is found for the given peripheral velocity of the central impression cylinder, which is equal to $v_1$, from the radius of the central impression cylinder, which is a constant. The longitudinal register path up to time point $t_{End}$ is incorporated accordingly. While the time point $t_{Start}$ is the same for all plate cylinders, the time point $t_{End}$ depends on the spatial position of the affected plate cylinder relative to the central impression cylinder. Because in this approach the adjustment of the longitudinal register—not measured values—is used which are detected by sensors, this can be considered a correction of a virtual longitudinal register error. Such a correction of the longitudinal register error is shown in FIG. 3 *b*).

FIG. 3 *c*) shows the velocity curve resulting from the above for the plate cylinder in question. The velocity difference $\Delta v$ and the velocity modification resulting from the longitudinal register correction exactly cancel each other out, such that the peripheral velocity $v_1$ is maintained between the time points $t_{Start}$ and $t_{End}$.

In this manner, a print image which was already in the process of being printed at the original speed, is also completely finished at this speed. This print therefore does not result in any waste paper.

The described approach is advantageous because in this case only little needs to be modified in printing machines of the prior art, in terms of control devices, in order to make it possible to carry out the method according to the invention. The so-called print repeat length correction—that is, the velocity v2—can be easily added. To prevent paper waste, the function for the longitudinal register correction, which is present in the prior art as well, can be modified by the addition of the calculated (rather than measured) values at this point.

In addition to the method according to the invention, a printing machine is also the subject matter of the invention, wherein an analysis and control device 26 is equipped with the described functions.

In the description above, as well as the drawings and the claims, various embodiments and features of a method according to the invention and of a device according to the invention have been described. All of these features can be freely combined with each other to the extent this is technically feasible, without departing from the scope of the present invention.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A method of adjusting a print repeat length of a print image in a multicolor rotary printing machine having a first plate cylinder and a second plate cylinder, the first plate cylinder and the second plate cylinder being associated with a shared central impression cylinder which conveys a print substrate, and a peripheral velocity of the first plate cylinder and a peripheral velocity of the second plate cylinder being adjusted relative to a peripheral velocity of the central impression cylinder, said method comprising the steps of:

modifying the peripheral velocity of the first plate cylinder during a printing operation, relative to the peripheral velocity of the central impression cylinder, and adjusting a longitudinal register of the first plate cylinder having the modified peripheral velocity; and as the print substrate travels from the modified and adjusted first plate cylinder to the second plate cylinder, modifying the peripheral velocity of the second plate cylinder relative to the peripheral velocity of the central impression cylinder, and adjusting the longitudinal register of the second plate cylinder having the modified peripheral velocity, with, for the first plate cylinder, the steps of modifying the peripheral velocity and adjusting the longitudinal register being effected simultaneously, and for the second plate cylinder, the steps of modifying the peripheral velocity and adjusting the longitudinal register being effected simultaneously.

2. The method according to claim 1, further comprising employing a control and/or regulating program having a procedure for controlling the peripheral velocity and having a procedure for controlling the longitudinal register, and calling the procedure for controlling the longitudinal register simultaneous with calling the procedure for controlling the peripheral velocity, with a modified value of the peripheral velocity being a basis for a new control value.

3. The method according to claim 1, wherein the velocity that is modified in the step of modifying of the peripheral velocity associated with the adjusting of the longitudinal register has a same magnitude, but an opposite sign, with respect to a desired modified peripheral velocity of the first plate cylinder and the second plate cylinder.

4. The method according to claim 1, wherein the multicolor rotary printing machine is a flexographic printing press.

5. A method of adjusting a print repeat length of a print image in a multicolor rotary printing machine having a first plate cylinder and a second plate cylinder, the first plate cylinder and the second plate cylinder being associated with a shared central impression cylinder which conveys a print substrate, and a peripheral velocity of the first plate cylinder and a peripheral velocity of the second plate cylinder being adjusted relative to a peripheral velocity of the central impression cylinder, said method comprising the steps of:

modifying the peripheral velocity of the first plate cylinder and the peripheral velocity of the second plate cylinder during a printing operation, relative to the peripheral velocity of the central impression cylinder;

adjusting a longitudinal register of the first plate cylinder having the modified peripheral velocity and a longitudinal register of the second plate cylinder having the modified peripheral velocity, with the step of modifying of the peripheral velocity and the step of adjusting of the longitudinal register being effected simultaneously; and employing a control and/or regulating program having a procedure for controlling the peripheral velocity and having a procedure for controlling the longitudinal register, and calling the procedure for controlling the longitudinal register simultaneous with calling the procedure for controlling the peripheral velocity, with a modified value of the peripheral velocity being a basis for a new control value.

6. The method according to claim 5, wherein the method includes modifying the peripheral velocity of the second plate cylinder simultaneously with the modifying of the peripheral velocity of the first plate cylinder.

7. The method according to claim 6, wherein the multicolor rotary printing machine includes another plate cylinder, and wherein the method includes modifying a peripheral velocity of the other plate cylinder simultaneously with the modifying of the peripheral velocity of the first plate cylinder and the second plate cylinder.

8. The method according to claim 6, wherein the modified peripheral velocity of the first plate cylinder and the modified peripheral velocity of the second plate cylinder are identical.

9. The method according to claim 5, wherein the velocity that is modified in the step of modifying of the peripheral velocity associated with the adjusting of the longitudinal register has a same magnitude, but an opposite sign, with respect to a desired modified peripheral velocity of the first plate cylinder and the second plate cylinder.

10. The method according to claim 5, wherein the multicolor rotary printing machine is a flexographic printing press.

* * * * *